US008577613B2

(12) United States Patent
Bryant et al.

(10) Patent No.: US 8,577,613 B2
(45) Date of Patent: Nov. 5, 2013

(54) EFFECTIVE HYDROCARBON RESERVOIR EXPLORATION DECISION MAKING

(75) Inventors: Ian D. Bryant, Houston, TX (US); Rodney Laver, Crawley Down (GB); Glenn Koller, Tulsa, OK (US); Hans Eric Klumpen, Meerbusch (DE); Robin Walker, Burgess Hill (GB); Andrew Bishop, Ampthill (GB); Andrew Richardson, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1066 days.

(21) Appl. No.: 12/495,942

(22) Filed: Jul. 1, 2009

(65) Prior Publication Data

US 2010/0174489 A1 Jul. 8, 2010

Related U.S. Application Data

(60) Provisional application No. 61/077,283, filed on Jul. 1, 2008.

(51) Int. Cl.
*G06F 19/00* (2011.01)

(52) U.S. Cl.
USPC ..... 702/6; 702/5; 702/14; 702/181; 367/73

(58) Field of Classification Search
USPC ..... 702/5–6, 14–16, 181; 367/73
See application file for complete search history.

(56) References Cited

U.S. PATENT DOCUMENTS

| | | | |
|---|---|---|---|
| 6,549,854 | B1 | 4/2003 | Malinverno et al. |
| 6,612,382 | B2 | 9/2003 | King |
| 2007/0137894 | A1 | 6/2007 | Fujisawa et al. |
| 2007/0179766 | A1 | 8/2007 | Cullick et al. |

OTHER PUBLICATIONS

Walls, M. R., Corporate Risk Tolerance and Capital Allocation: A Practical Approach to Implementing an Exploration Risk Policy, Journal of Petroleum Technology, Apr. 1995, vol. 47, No. 4, pp. 307-311, Society of Petroleum Engineers.

Agbon, I.S., et al., Fuzzy Ranking of Gas Exploration Opportunities in Mature Oil Fields in Eastern Venezuela, Society of Petroleum Engineers Annual Technical Conference and Exhibition, Oct. 2003, Denver, CO, SPE 84337, pp. 1-7.

Schiozer, D.J., et al., Use of representative models in the integration of risk analysis and production strategy definition, Journal of Petroleum Science and Engineering, Oct. 2004, vol. 44, Issues 1-2, pp. 131-141.

Suslick, S.B., et al., Risk analysis applied to petroleum exploration and production: an overview, Journal of Petroleum Science and Engineering, Oct. 2004, vol. 44, Issues 1-2, pp. 1-9.

Cullick, S., et al., Optimizing Multiple-Field Scheduling and Production Strategy With Reduced Risk, Society of Petroleum Engineers Distinguished Author Series, Nov. 2004, SPE 88991, pp. 77-83.

(Continued)

*Primary Examiner* — Jonathan C Teixeira Moffat
*Assistant Examiner* — Hien Vo
(74) *Attorney, Agent, or Firm* — Lam Nguyen; Rodney Warfford

(57) ABSTRACT

An improved methodology for managing hydrocarbon exploration of at least one prospect. The methodology involves iterative processing that allows decision makers to iterate on assumptions and refine underlying probabilistic models as well as optimize the set of recommended exploration activities that are to be performed over time as additional knowledge is gained.

21 Claims, 7 Drawing Sheets

(56) References Cited

OTHER PUBLICATIONS

Ruffo, P., et al., Hydrocarbon exploration risk evaluation through uncertainty and sensitivity analyses techniques, Reliability Engineering and System Safety, Oct.-Nov. 2006, vol. 91, Issues 10-11, pp. 1155-1162.

Patent Cooperation Treat International Search Report, Form PCT/ISA/210, Date of mailing Sep. 1, 2009, pp. 1-2.

Malvic, T. et al., Using of Exponential Function in Risk Assessment for Investment in Potential Hydrocarbon Discovery, 2007. Retrieved from: http://bib.irb.hr/datoteka/284755.Exponential_function.doc, pp. 1-13.

Baseline Resolution, Inc. Basin Hydrocarbon Charge Risk, 2006. Retrieved from the Internet Archive Wayback Machine: <URL: http://web.archive.org/web/20061120025649/http://www.brilabs.com/downloads/basin_modeling1.pdf>, pp. 1-4.

Behrenbruch, P., et al., Uncertainty and Risk in Petroleum Exploration and Development: The Expectation Curve Method, Society of Petroleum Engineers Asia-Pacific Conference, Sydney, Australia, Sep. 1989, SPE 19475, pp. 99-114.

Schlumberger, Integrated Services for Exploration, 2008, pp. 1-2.

EFFECTIVE HYDROCARBON RESERVOIR EXPLORATION DECISION MAKING

CROSS-REFERENCE TO RELATED APPLICATIONS

This application claims benefits from U.S. Provisional Patent Application No. 60/077,283, filed Jul. 1, 2008, entitled "Effective Hydrocarbon Reservoir Exploration Decision Making," the contents of which are hereby incorporated herein by reference.

BACKGROUND OF THE INVENTION

1. Field of the Invention

The present application relates generally to the exploration of hydrocarbon reservoirs, and more particularly to methodology and supporting systems for managing business decisions on where and how to explore for hydrocarbon reservoirs.

2. State of the Art

Oil and gas exploration and production (E & P) companies create value for their owners or shareholders by exploiting hydrocarbon accumulations for commercial gain. To maintain owner/shareholder value, they must replace reserves (their asset base) whilst maintaining production rates (their revenue stream). Other entities, such as state-owned national oil companies and the like, also exploit hydrocarbon accumulations for commercial gain and most often have a desire to replace reserves. Reserves can be replaced through exploration, improving existing field recovery factors, and acquisition of existing discoveries or fields.

For new ventures, the exploration process typically begins with a high level analysis of known field size distribution and economic attractiveness of the exploitation of hydrocarbons in any county throughout the world. The right to explore for hydrocarbons in a country is typically granted by a government licensing body for considerable sums of money, a technical work program (commitment), or both. The work program will typically depend on how much work has previously been done and how much technical insight with respect to the area is known in advance of the award. Work programs are usually limited in time and may require the licensee to perform activities by certain dates, e.g., to acquire seismic data and/or drill exploratory wells to attempt to establish the location of economically producible hydrocarbon accumulations.

For the licensee, there is a strong incentive to execute the exploration process as quickly and effectively as possible due to the fact that:

- the license may expire before a commercial discovery is made; and
- in net present value (NPV) terms, no commercial valuation is positively impacted until additional reserves can be booked as a result of the exploration process.

In offshore areas, exploration costs may be very high. Onshore is usually less expensive for drilling, but 3D seismic data acquisition may be more expensive than offshore. Very few areas of the world have not already had at least one phase of exploration. The whereabouts of most sedimentary basins is known. Most commonly, companies enter a known basin or area with new ideas and/or technology. Not all countries release pre-existing well and seismic data prior to license award.

The exploration for hydrocarbons in any area varies depending on what is known or what work has been done in advance. Prior knowledge and work results help companies understand uncertainty and the probability of finding hydrocarbons. Managing uncertainty and risk are vital components of successful exploration.

For E&P companies, the exploration process typically involves the following. First, in order to gain access to a basin or part thereof, the company first pays for a license to explore. The company then assimilates existing data (such as well logs from previously drilled wells) or previously acquired geophysical data (such as seismic or magnetic surveys). The company may then need to reprocess this existing data or collect new data such as surface geochemical samples or seismic data in order to determine which parts of the licensed acreage are most prospective. Petrophysical analysis of wells and rock samples for reservoir properties and source rock potential is often undertaken in parallel. If promising geological structures (referred to as "leads") are identified, it may be necessary to acquire more densely sampled seismic data or electromagnetic data to try to increase the probability that a given subsurface structure (a "prospect") is charged with hydrocarbons. In the exploration process, there is a delicate balance to be struck between time and cost of work to understand uncertainty and the probability of mitigating risk.

For economic hydrocarbons to be encountered in any prospect, the following technical conditions must simultaneously be met:

1) a valid trap is present to retain the hydrocarbons at high saturations in sufficient quantities as to be commercially viable,
2) a reservoir formation is present that has sufficient porosity to store mobile hydrocarbons and sufficient permeability to allow them to flow into a wellbore at commercial rates,
3) after its formation (timing) the trap needs to have received a hydrocarbon charge from
4) mature source rocks with accessible migration pathways.
5) The trap must also have retained the charge due to the presence of a seal, impermeable vertical and horizontal barriers, lithology and faults etc. that prevent the hydrocarbons from escaping.

Work by geoscientists as part of the exploration process aims to establish the likelihood that these conditions have been met, i.e., the probability of success. This is usually achieved by integrating geophysical measurements and geological inference from outcrops, surface samples or analogue accumulations. Additional data and information helps to reinforce estimates of the likelihood of a positive or negative outcome.

When an E&P company or other entity is sufficiently confident that all these criteria may have been met at a given location in the subsurface and the accumulation is estimated to be large enough to be commercially attractive, the prospect may be drilled. Only once a prospect has been drilled and tested (and possibly appraised by other wells) may the reserves be booked, and thus increase the asset base and net worth of the company or entity. The process of moving from having acquired an exploration license to drilling a well to test a prospect may take hundreds of millions of dollars and several years. In this time period, the exploration activities represent negative cash flow and no added value to the company until a discovery is established by drilling a well that discovers a commercially viable hydrocarbon accumulation.

From the foregoing it is clear that E&P companies and other entities are strongly motivated to accelerate the exploration process as much as possible, whilst working at the same time to understand uncertainty and manage the risk that this acceleration, and any consequential lack of work, does not lead to drilling a prospect that does not contain commercial quantities of hydrocarbons. It should also be understood that hydrocarbon exploration involves taking calculated, but inherent, risk and that it is usually not possible to completely eliminate the possibility of drilling a prospect that does not contain commercial quantities of hydrocarbons, particularly in a cost effective manner.

In an ideal case, an E&P company or other entity should spend no more than necessary to delineate the prospect in the shortest amount of time such that an exploration well may be safely and successfully drilled to establish the presence of a commercial hydrocarbon accumulation. In practice, this goal is not met because of a variety of issues, which can include one or more of the following:

- Difficulty of efficiently assimilating the existing data,
- Inefficiencies in constructing basin-scale charge and play models from the data,
- Acquisition of additional data and processing,
- Updating of basin-scale play fairway models with new information,
- Definition of the prospect: trap, reservoir, seal, migration and timing,
- Evaluation of uncertainties, probabilities, risks and economics,
- Construction of exploration well design and operation programs,
- Contracting of drilling rig, and
- Drilling and evaluating the first exploration well on the prospect.

Previous technologies have typically aimed at improving the efficiency of various elements of this exploration process. SPE 84337, for instance, discloses a method to capture uncertainties as part of decision tree analysis and Monte Carlo simulation. The decision tree had two branches. The first branch consisted of volume related events (Remaining Gas Reserves, Remaining Oil Reserves, Gas Gap Volume) and gave an idea of the amount of gas in a reservoir. The second branch consisted of performance related events (Average Oil Production Rate per Reservoir Pressure Change, Average Gas Production Rate per Reservoir Pressure Change, Flow Capacity, Oil Storage Capacity, and Distance to gas pipelines) and gave an idea of how much gas could be reasonably produced from the reservoir. The data for each event were normalized (0-1) and a swing weighting method used to calculate probabilities of occurrence of each event. These probabilities were designated as assumption cells with the probability density functions based on best-fit curves. A rolling netback calculation was carried out with normalized values of the events and their respective forecasted probabilities of occurrences until a final rank score was obtained.

SUMMARY OF THE INVENTION

The present invention provides a methodology for managing hydrocarbon exploration of at least one prospect. The methodology involves a plurality of process iterations carried out over time. During each processing iteration, a number of operations are performed as follows. First, in operation a), input parameters representing attributes of the prospect are used as input data to a risk-based probabilistic computer system. The risk-based probabilistic computer system generates estimates of probability-of-success and corresponding hydrocarbon volumes for the prospect as well as key performance indicators for prospect in accordance with the input data. Second, in operation b), the key performance indicators generated in a) are reviewed to identify at least one gap in knowledge of the prospect as well as identify recommended exploration activities that best address each identified knowledge gap. In operation c), zero or more of the recommended exploration activities identified in b) are performed. In operation d), results arising from performance of the recommended exploration activities in c) are reviewed to identify additional knowledge gained from such performance. And in operation e), the input parameters are updated to reflect the additional knowledge identified in d) for the next process iteration.

It will be appreciated that such iterative processing allows decision makers to iterate on assumptions and refine underlying probabilistic models as well as optimize the set of recommended exploration activities that are to be performed over time as additional knowledge is gained. In this manner, such iterative processing significantly reduces the possibility of drilling a prospect that does not contain commercial quantities of hydrocarbons, particularly in a cost effective manner.

According to one embodiment of the invention, the methodology generates data defining an initial as-is characterization of the prospect. Some of this data might be used as input data to the risk-based probabilistic computer system in the operations of a). In the preferred embodiment, such data is generated by execution of a software application that guides conversation amongst a number of representatives, the conversation pertinent to the initial as-is characterization of the prospect.

According to another embodiment of the invention, the methodology evaluates changes in the key performance indicators as a result of at least one process iteration to identify a classification for the prospect, and additional actions for the prospect are selectively performed based upon the classification of the project.

In the preferred embodiment, the methodology of the present invention couples the technical expertise of the service company with the understanding of risk and key performance metrics of the employees of the entity to manage exploration activities of a prospect in an efficient and optimized manner.

Additional objects and advantages of the invention will become apparent to those skilled in the art upon reference to the detailed description taken in conjunction with the provided figures.

DETAILED DESCRIPTION OF THE PREFERRED EMBODIMENTS

The present invention comprises a multi-stage process for managing and optimizing exploration activities of an entity. It manages business decisions that answer where and how to explore for hydrocarbon reservoirs. Additionally it is a methodology to determine how much effort to expend and where to optimally deploy these efforts for maximum benefit.

The process involves conversations and interaction between employees or consultants of an entity, or other persons acting for the benefit of the entity (hereinafter referred to "representatives"). The representatives of the entity act for the benefit of the entity and need not have legal authority to legally bind the entity in any manner. The representatives of the entity preferably include consultants that are not employees of the entity, but work as part of a services company on behalf of the entity (for example, as part of exploration management services provided to entity). The consultants of the services company preferably comprise a multi-disciplinary team including experts from a variety of technical specialties that are important to the exploration process (e.g., geologists and/or geophysicists for expertise in 2D and 3D seismic interpretation and stratigraphic mapping and other functions, geochemists for expertise in oil sample analysis; scientists for expertise in production issues, financial and business experts for expertise in financial risk analysis and issues related to oil exploration and production, etc.). In the typical scenario, the employees of the entity understand the risk tolerance of the entity as well as the key metrics (e.g., KPIs as described below) required for the prospect to satisfy such risk tolerance; whereas, the consultants of the service company understand the technologies that are likely to have a positive impact on the key metrics for the prospect. In this scenario, the methodology of the present invention couples the technical expertise of the service company with the understanding of risk and key performance metrics of the employees of the entity to manage exploration activities of a prospect in an efficient and optimized manner.

Figure 1A:
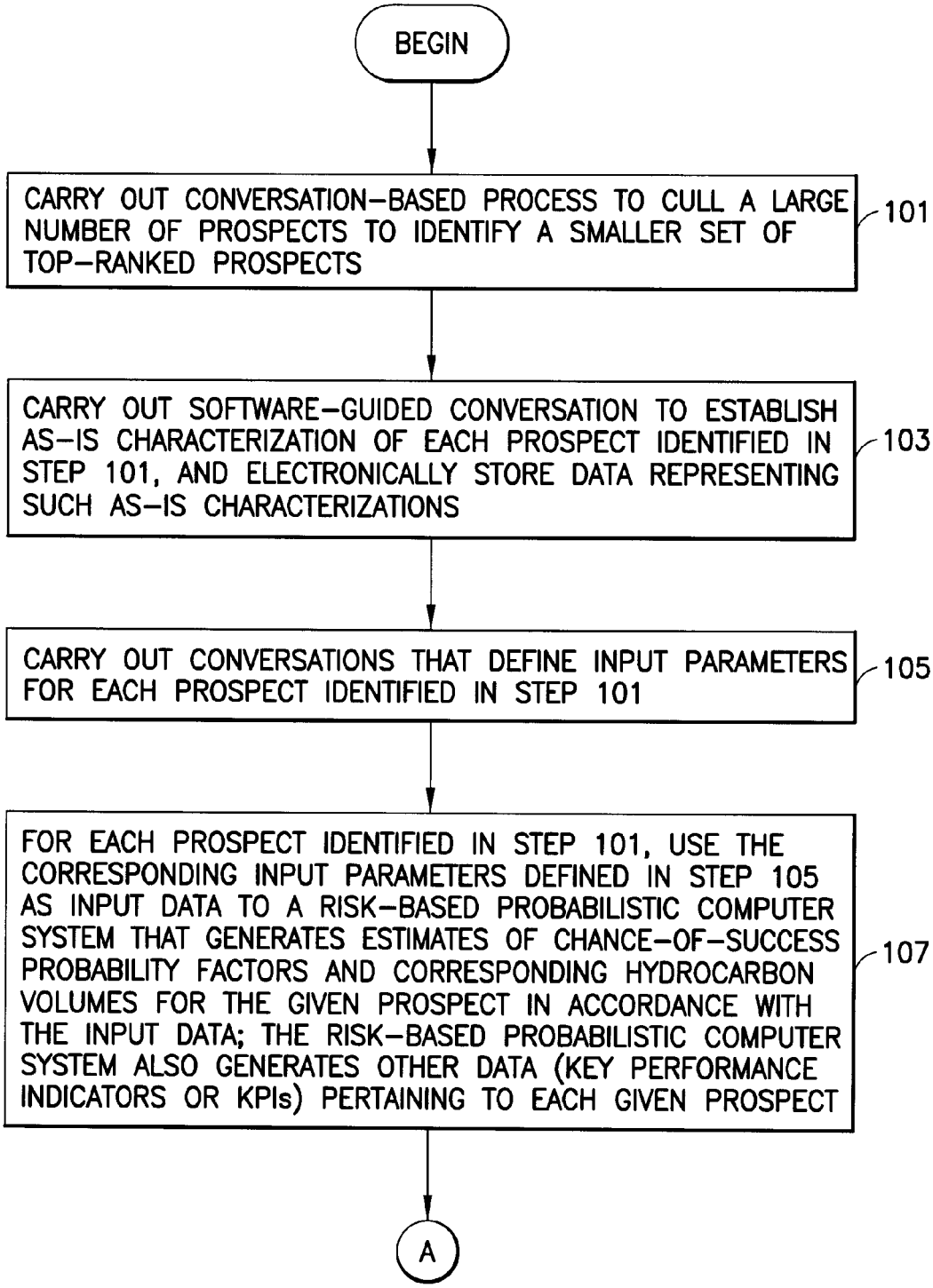
FIGS. 1A-1C, collectively, is a flow chart illustrating a methodology for managing hydrocarbon exploration for at least one prospect in accordance with the present invention.
Figure 1B:
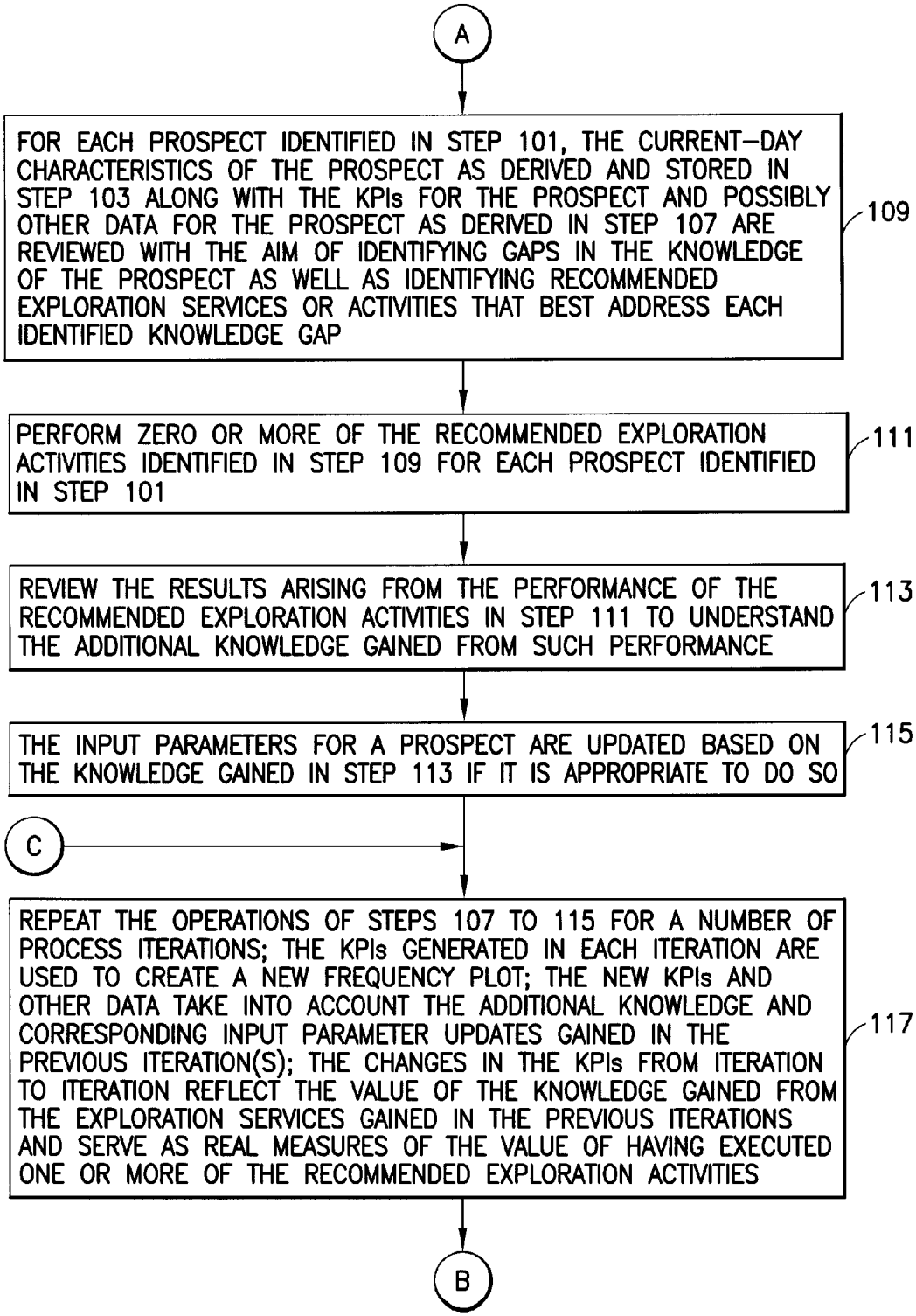
Figure 1C:
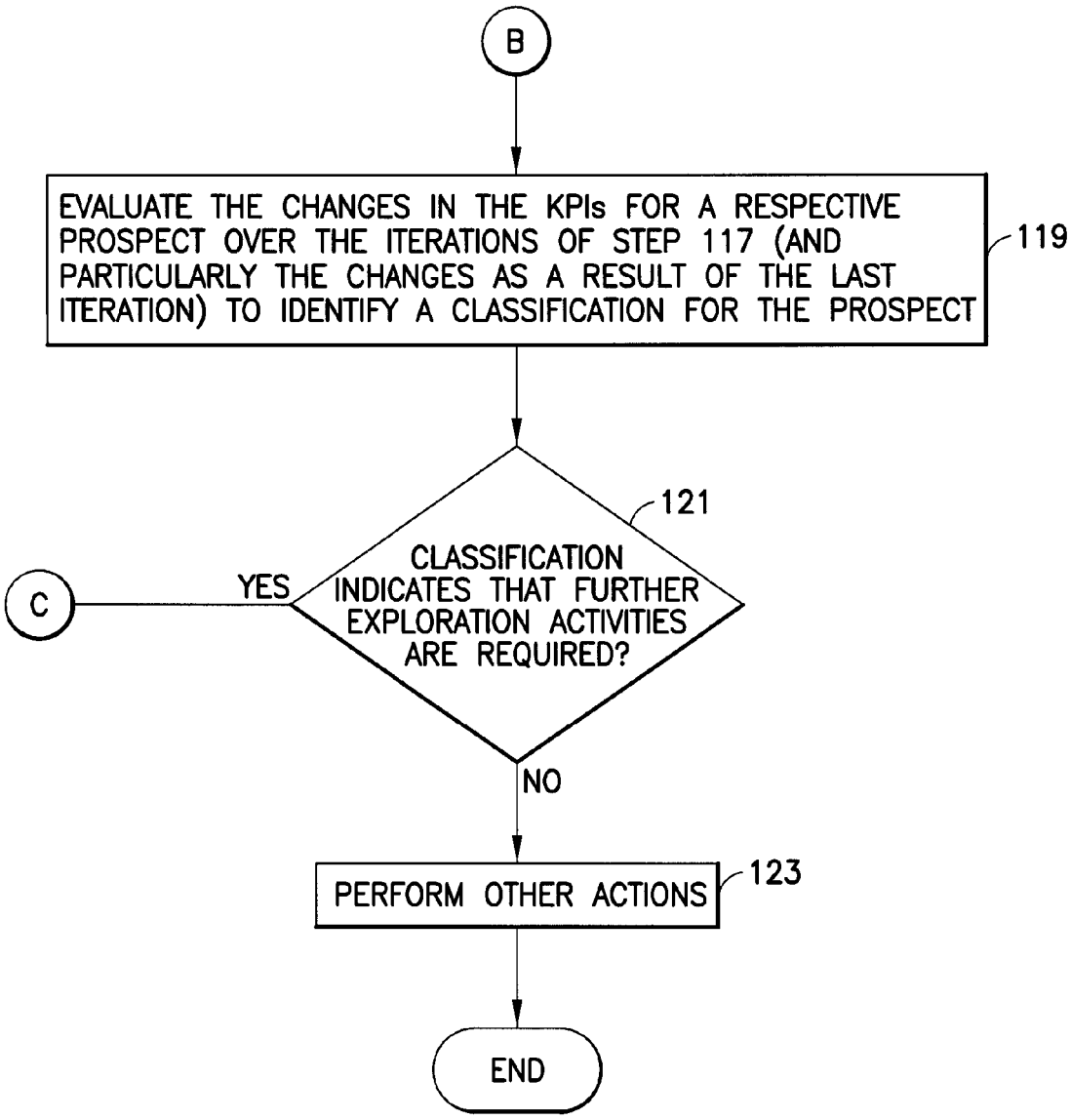

Turning now to FIG. 1, there is shown a methodology for managing and optimizing exploration activities of an entity in accordance with the present invention. The methodology begins in step 101 wherein representatives of the entity carry out a conversation-based process to cull a relatively large number of exploration projects (prospects) to identify a relatively small set of top-ranked prospects. In the preferred embodiment, the conversation-based process involves discussions and interaction amongst the representatives of the entity in one or more meetings. The conversation-based process can also involve other forms of communication, such as emails, IM messages and the like.

In step 103, the representatives of the entity carry out software-guided conversations that establish the "as is" or current-day characterization of each prospect of the set identified in step 101. The data representing a current-day characterization for each given prospect is stored electronically by the software that guides the conversations of step 103. The current-day characterization of a given prospect establishes the amount and quality of information currently available for the given prospect. This information can be used later to recommend the performance of additional exploration activities for the given prospect, where such additional activities are aimed at making more complete the information needed to determine the viability of the prospect.

In step 105, the representatives of the entity carry out conversations with the aim of defining input parameters for each prospect of the set identified in step 101. The input parameters preferably represent standard and universally-used variables that address petroleum-system attributes such as

- Source-rock characteristics;
- Kerogen conversion to hydrocarbons;
- Hydrocarbon characteristics (e.g. API gravity, gas:oil ratio);
- Migration efficiency;
- Reservoir characteristics (e.g., porosity, permeability);
- Timing of trap formation; and
- Recovery factors.

Figure 2A:
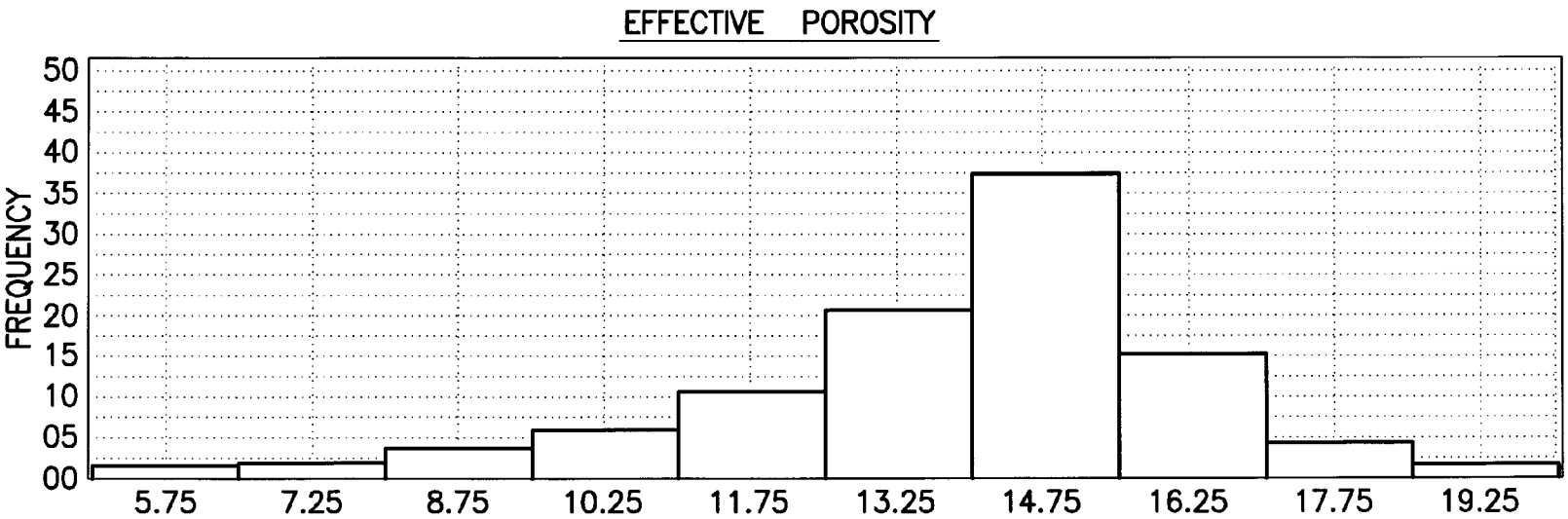
FIG. 2A is a bar chart illustrating an exemplary frequency distribution characterizing effective porosity of a prospect; this distribution of effective porosity values can be used as input to a risk-based probabilistic computer system as part of the methodology of FIGS. 1A-1C.
Figure 2B:
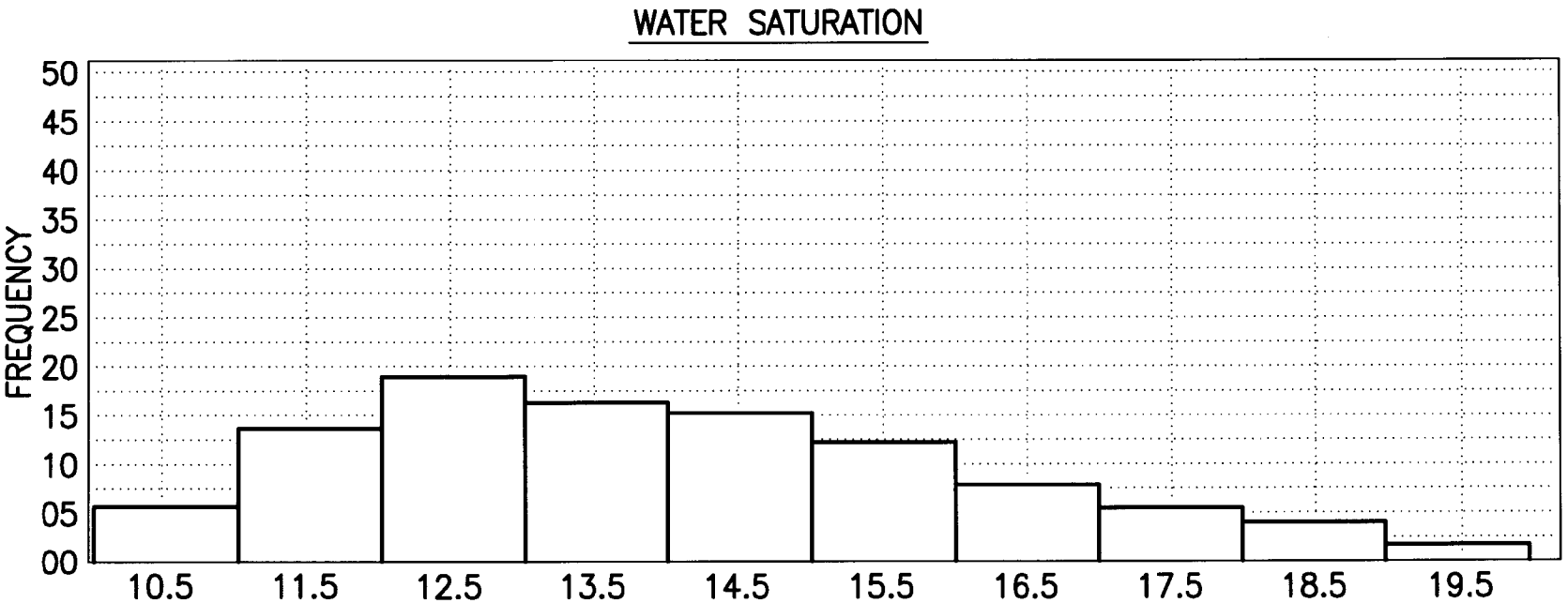
FIG. 2B is a bar chart illustrating an exemplary frequency distribution characterizing water saturation of a prospect; this distribution of water saturation values can be used as input to a risk-based probabilistic computer system as part of the methodology of FIGS. 1A-1C.
Figure 2C:
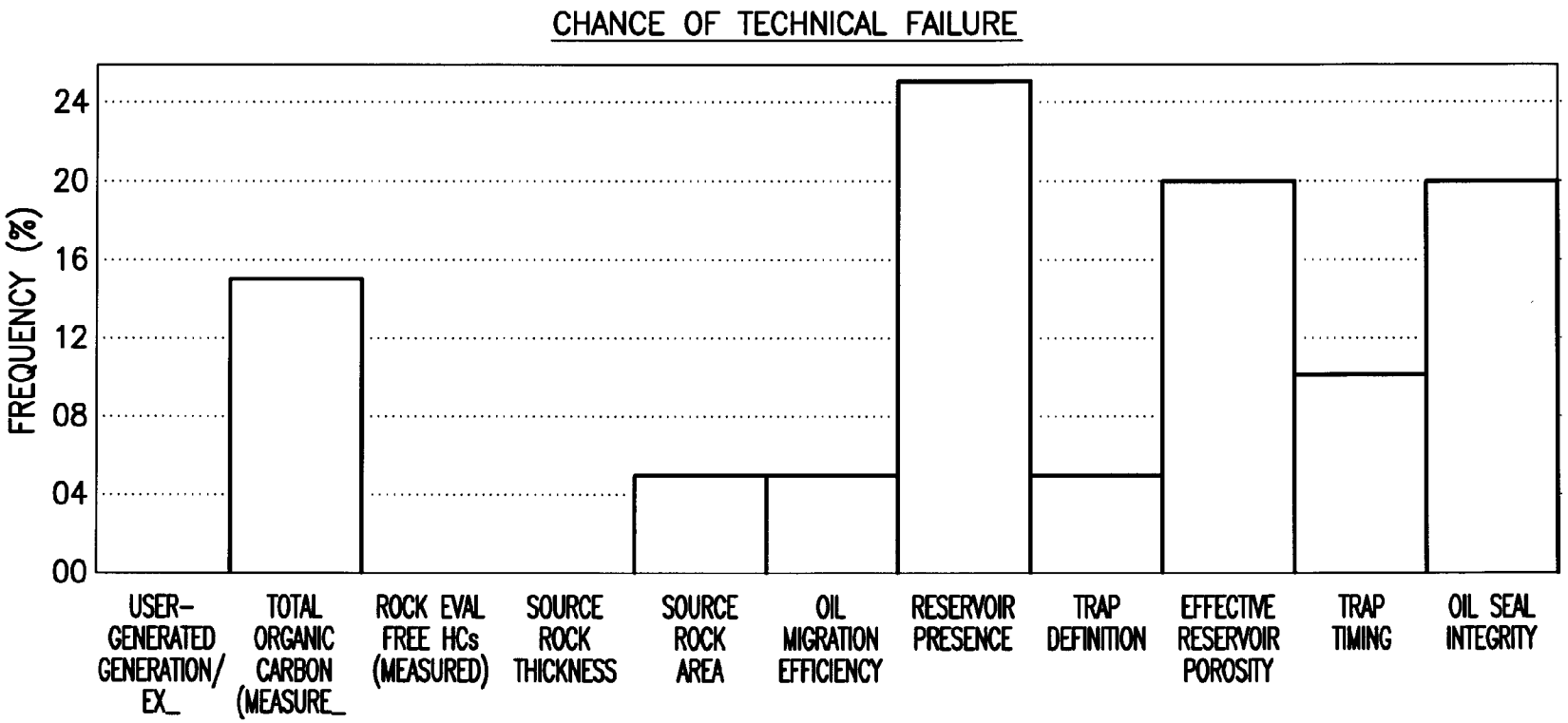
FIG. 2C is a bar chart illustrating exemplary chance-of-failure values of a number of petroleum-system attributes; these chance-of-failure values can be used as input to a risk-based probabilistic computer system as part of the methodology of FIGS. 1A-1C.

Most input parameters are preferably defined as probability distributions that characterize uncertainty of certain petroleum-system attributes, such as effective porosity and water saturation as shown in FIGS. 2A and 2B. Some input parameters are also preferably defined by chance-of-failure values of a number of petroleum-system attributes, such as source rock thickness, source rock area, oil migration efficiency, reservoir presence, trap definition, effective reservoir porosity, trap timing and oil seal integrity as shown in FIG. 2C. These chance-of-failure values represent the possibility that the corresponding input variable fails to reach a minimum threshold value. The input parameters can also relate to other data.

Figure 3:
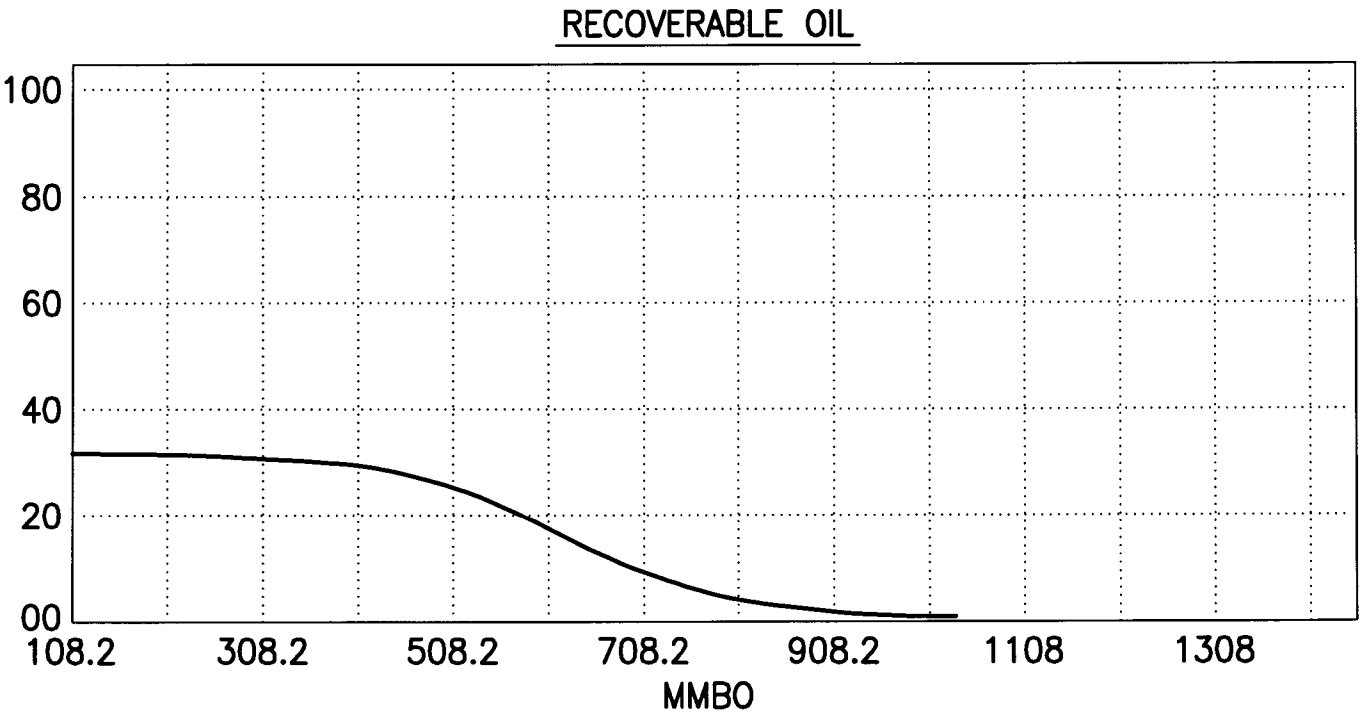
FIG. 3 is an exemplary cumulative frequency plot that is generated and displayed by a risk-based probabilistic computer system as part of the methodology of FIGS. 1A-1C.

In step 107, for each prospect of the set identified in step 101, the input parameters for the prospect as defined in step 105 are used as input data to a risk-based probabilistic computer system that generates estimates of the probability-of-success and corresponding hydrocarbon volumes for the given prospect in accordance with the input data. The risk-based probabilistic computer system preferably outputs a display of these estimates, such as a cumulative frequency plot as shown in FIG. 3. The cumulative frequency plot includes estimated hydrocarbon volumes on the X axis (for example, in Millions of Barrels of Oil or MMBO as shown) and estimated probability-of-success along the Y axis. In the preferred embodiment, the cumulative frequency plot is generated by carrying out industry-standard Monte Carlo analysis by sorting the results of a number N (for example, N=5000) of Monte Carlo iterations to form the range of values on the X axis. The Y axis is divided into N equal segments. The curve is plotted by starting at the "right" end of the X axis and counting the number of Monte Carlo iterations that share a given X axis value. This count dictates the Y-axis value of the curve at the given X axis value.

As part of step 107, the risk-based probabilistic computer system also generates other data (Key Performance Indicators or KPIs) pertaining to each given prospect. The risk-based probabilistic computer system employs a probabilistic model that takes into account risk and uncertainties of a number of petroleum-system variables in order to generate estimates of probability-of-success and corresponding hydrocarbon volumes as well as key performance indicators and possibly other data for the given prospect in accordance with the input parameter data supplied thereto. An example of such a probabilistic model is described in the paper by Ruffo et al, entitled "Hydrocarbon exploration risk evaluation through uncertainty and sensitivity analysis techniques," Reliability Engineering and System Safety 91, Elsevier Ltd., 2006, pgs. 1155-1162, herein incorporated by reference in its entirety.

A KPI as it pertains to a particular prospect is a metric that aids in defining and evaluating the success of the entity in the exploration of the particular prospect. Examples of such KPIs include Chance of Technical Success (CTS), Chance of Economic Success (CES), Probabilistic Economic Resources (PER), Minimum Volume (MinV), and Maximum Volume (MaxV).

The CTS metric represents the probability that the prospect will satisfy all technical conditions required for a valid prospect (e.g., the five technical conditions outlined above). The CTS metric is preferably calculated by integrating all of the individual risk-system-parameter chances of failure for the prospect. For example, if the chances of failure associated with porosity and trap timing were 50% and 35% respectively, the CTS is preferably calculated as:

$$\begin{aligned} CTS &= (1 - COF\ \text{porosity}) \times (1 - COF\ \text{trap timing}) \\ &= (1 - 0.5) \times (1 - 0.35) = \\ &= 0.5 \times 0.65 \\ &= 0.325 \text{ or a } 32.5\% \text{ Chance of Technical Success} \end{aligned}$$

The CTS metric corresponds to the point on the Y axis at which the cumulative frequency curve intercepts the Y axis as shown in FIG. 3.

The CES metric represents the probability that the prospect will be economically feasible (i.e., the revenue generated from hydrocarbons recovered from the prospect will be greater than the costs associated with the exploration and production of such hydrocarbons). The CES metric is preferably derived by estimating the recoverable hydrocarbon volume for the prospect (e.g., in MMBO) that the company requires in order to "break even" economically. In FIG. 3, the CES metric would be represented as a vertical line emanating from the "break even" value on the X axis (not shown). The line would intercept the cumulative frequency curve. A horizontal line drawn from that point of interception to the Y axis indicates the chance that the prospect will be economically successful. In the preferred embodiment, the estimate of the "break even" recoverable hydrocarbon volume is dependent on the estimated exploration costs of the prospect over time, estimated production costs for the prospect over time, estimated sale price for the oil recovered from the prospect over time, etc. Computer-based analysis that takes into account risk and uncertainties of such variables can be used to derive the estimate of the "break even" recoverable hydrocarbon volume for a particular prospect.

The PER metric represents the amount of resources that a prospect would contribute to a portfolio of prospects on a fully risk-weighted basis. The PER metric is preferably calculated by integrating the area under the cumulative frequency curve bounded by the X axis, the cumulative frequency curve to the "right" of the "break even" value of the CES metric, the horizontal line emanating from the intercept of the "break even" value of the CES metric and the cumulative frequency curve, and the Y axis between 0 and the CES metric.

The AEC metric is the resource level around which a project team would plan (facilities size, logistical considerations, etc.). The AEC metric is preferably calculated as the mean of all of the cumulative-frequency-plot values greater than the "break even" value of the CES metric.

The MinV metric represents the minimum recoverable hydrocarbon volume that can be expected from the prospect. The MinV metric is preferably identified as the "left most" point on the cumulative frequency curve of FIG. 3 and, therefore, is the minimum value generated by the industry-standard Monte Carlo (probabilistic model) process.

The MaxV metric represents the maximum recoverable hydrocarbon volume that can be expected from the prospect. The MaxV metric is preferably identified as the "right most" point on the cumulative frequency curve of FIG. 3 and, therefore, is the maximum value generated by the industry-standard Monte Carlo (probabilistic model) process.

In step 109, for each prospect of the set identified in step 101, the representatives of the entity review the current-day characteristics of the prospect as derived and stored in step 103 along with the KPIs for the prospect and possibly other data for the prospect as derived in step 107 with the aim of identifying one or more gaps in the knowledge of the prospect as well as identifying recommended exploration services or activities that best address each identified knowledge gap. In order to illustrate the operations of step 109, consider an exemplary prospect with Chance of Failure (COF) estimates as shown in the bar chart of FIG. 2C. These COF estimates are preferably arrived at through conversations between representatives of the entity as part of step 105. The COF estimates represent the probability (% chance) that the prospect will be a "dry hole" due to the particular input parameter. For example, if it is believed that the hydrocarbons might have migrated (from the position of the source rock) past the position of the trap prior to trap formation, then Trap Timing would be deemed a chance of failure (chance the prospect will fail because the trap was not there when the hydrocarbons migrated past the position of the trap). Through conversations between representatives of the entity, a consensus is reached regarding the percent chance that the prospect will fail due to Trap Timing. That percentage is the "height" of the Trap Timing bar in FIG. 2C. In this example, it is likely that the representatives will agree that Trap Timing is a knowledge gap for the prospect, and identify one or more recommended exploration activities be undertaken to address this knowledge gap. Such recommended exploration activities can include one or more of the following:

- re-processing of seismic data to better understand trap geometry;
- Migration modeling and/or Basin structural modeling of the prospect to better understand timing of trap formation; such modeling can be carried out using the PetroMod modeling software commercially available from Schlumberger or carried out as a service by Schlumberger in a regional service center;
- acquisition and analysis of 3-D seismic data; these services can be carried out by a geophysical services company such as WesternGeco, a business unit of Schlumberger; and Data & Consulting Services another business unit of Schlumberger.

Note that a wide range of recommended exploration activities can be identified as part of step 109. For example, each X-axis parameter of FIG. 2C (as well as other parameters) could generate its own large set of unique recommended industry-standard activities. Moreover, the knowledge gaps identified in step 109 can relate to a wide range of petroleum-system attributes, such as source-rock thickness, trap timing (as described above), migration pathway, petrophysical attributes of reservoir, etc.

In identifying recommended exploration services or activities that address a particular knowledge gap, the conversation of the representatives typically address two important questions with respect to a recommended exploration or activity. The first of these is "if it worked, what difference would it make?" Very often, this is defined in the language of future optimization or cost reduction. For example, a water flood is expected to provide a certain increase in reservoir pressure and this in turn would increase production by a certain amount. This, once again, can usually be made objective and subject to some formulaic model or through application of high-level models that produce KPIs that reflect the incremental increase in value of the proposed activity. There are, however, very few technical scenarios that can be modeled fully, as each one tends to be quite complex. It is important to note here that the value achieved for the same technical and operational effort is not linear or uniform. For example, 3D seismic may be used to define accumulations too small to be confidently identified from 2D seismic. However, the value of such prospects will be dictated by the development costs. For example, small accumulations near existing infra-structure in the North Sea may be economically attractive whereas in deep water offshore West Africa they may not be economically viable. The second question is "Will it work here?" This is a genuinely subjective element, and might not result in a "single answer." Confidence in a particular outcome from the use of a given technology will depend on the effort involved. However, the cost effectiveness, technical effectiveness, and confidence in success associated with a technology are almost universally unknown in advance of the activity taking place. In identifying recommended exploration services or activities that address a particular knowledge gap, the recommended activities preferably have a high ratio of ratio of incremental estimated value versus estimated cost as compared to those activities that are not recommended.

In step 111, the entity (or another company on behalf of the entity) performs zero or more of the recommended exploration activities identified in step 109.

In step 113, the representatives of the entity review the results arising from the performance of the recommended exploration activities in step 111 to understand the additional knowledge gained from such performance.

In step 115, the representatives of the entity update the input parameters for a prospect based on the knowledge gained in step 113 if appropriate to do so. For instance, with respect to the Trap Timing example discussed above, the results of migration modeling can be reviewed by the representatives of the entity to better understand the migration pathways and timing of the hydrocarbon migration past the potential site of the trap. With this additional knowledge, the representatives of the entity can update the input parameters relating to such trap timing as defined in step 105 if need be.

After step 115, the operations continue to step 117 wherein the operations of steps 107 to 115 are repeated for a number of additional process iterations. In each additional process iteration, the input parameters for the prospect as initially defined in step 105 and any updates thereto as derived in step 115 over the previous process iteration(s) are used as input data to the risk-based probabilistic computer system that generates estimates of probability-of-success and corresponding hydrocarbon volumes for the given prospect. As part of such iterations, the risk-based probabilistic computer system also generates other data (Key Performance Indicators or KPIs) pertaining to each given prospect. Note that the KPIs generated by each iteration of steps 107 to 115 are used to create a new frequency plot (FIG. 3). The new KPIs and other data take into account the additional knowledge and corresponding input parameter updates gained in the previous iteration. The changes in the KPIs from iteration to iteration reflect the value of the knowledge gained from the exploration services performed in the previous iterations and serve as real measures of the value of having executed one or more of the recommended exploration activities. The iterative processing of step 117 for a respective prospect is continued as necessary before proceeding to step 119.

In step 119, the representatives of the entity evaluate the changes in the KPIs for a respective prospect over the iterations of step 117 (and particularly the changes as a result of the last iteration) to identify a classification for the prospect. This classification will be with respect to the entity's risk profile. What is acceptable risk to a company with a high-risk portfolio may be an unacceptably high level of risk to a more conservative company.

Examples of classifications that can be assigned to a prospect include:

- Evaluation stage is complete and the results of exploration activities for the corresponding prospect provide an inference of the presence of a commercially-viable hydrocarbon reservoir in the particular geographical area with acceptable risk and uncertainty. The entity may then add this prospect to its drilling program. As part of the drilling program, the prospect is typically drilled and tested (and possibly appraised by other wells). Such testing typically involves downhole fluid sampling and analysis to accurately characterize the fluid properties of the hydrocarbons (e.g., pressure, layering, hydrocarbon content, water content, etc.) of the prospect as well as the physical properties (e.g., permeability, porosity) of the earth formations that contain such hydrocarbons. The results of such testing are evaluated to further characterize the hydrocarbon volume of the prospect and book the estimated hydrocarbon volumes as a reserve if appropriate. When booked, the estimated hydrocarbon volume of the reserve increases the asset base and net worth of the entity.
- Evaluation stage complete and the results of the exploration activities for the corresponding prospect provide an inference of the absence of a commercially-viable hydrocarbon reservoir in the particular geographical area with acceptable risk and uncertainty. In this case, the entity may elect to relinquish this prospect.
- Evaluation stage complete and the results of the exploration activities for the corresponding prospect fail to provide an inference of the presence or absence of a commercially-viable hydrocarbon reservoir in the particular geographical area with acceptable risk and uncertainty. In this case, the entity may elect to hold but not drill the prospect, or seek to sell or farm-out the prospect.
- Evaluation stage not complete, further exploration activities are recommended.
- Evaluation stage not complete, postponement of further exploration activities is recommended.

In step 121, it is determined if the classification identified in step 119 indicates that further exploration activities are recommended. If so, the operations can return to step 117 to perform further exploration activities as shown (or alternatively, the processing ends for the prospect). Otherwise, other suitable actions can be performed in step 123 as outlined above and the methodology ends.

Generally, the iterative processing of the methodology of the present invention allows the representatives of the entity to iterate on assumptions and refine the underlying probabilistic models and optimizes the set of recommended exploration activities that are to be performed by the entity over time as additional knowledge is gained. In this manner, such iterative processing significantly reduces the possibility of drilling a prospect that does not contain commercial quantities of hydrocarbons, particularly in a cost effective manner. It is also possible to define a workflow for the exploration of a prospect that optimizes the set of recommended exploration activities that are to be performed by the entity over time.

The inventive methodology may also be characterized as:

- a means of objectively recommending exploration activities for one or more prospects over time in order to optimize the value to the exploration decision making process;

a holistic approach to aligning exploration activities for work managed by a team working sequentially or in parallel;

a system for effective budgetary planning for work activities on operated and non-operated ventures globally or locally;

a process that provides for the systematic organization and management of existing and new exploration assets;

a means of generating an effective knowledge database and transfer for management of existing and new exploration assets; and a means for coupling the technical expertise of the service company with the understanding of risk and key performance metrics of an E&P company or other entity in order to manage exploration activities of a prospect in an efficient and optimized manner.

The risk-based probabilistic computer system and other software functionality as described herein is preferably realized on a computer workstation, which includes one or more central processing units (CPUs) that interface to random-access memory (RAM) as well as persistent memory such as read-only memory (ROM). The computer workstation further includes a user input interface, input/output interface, display interface, and network interface. The user input interface is typically connected to a computer mouse, and a computer keyboard, both of which are used to enter commands and information into the computer workstation. The user input interface can also be connected to a variety of input devices, including computer pens, game controllers, microphones, scanners, or the like. The input/output interface is typically connected to one or more computer hard-drives and possibly one or more optical drives (e.g., CD-ROM/CDRW drives, DVD-ROM/DVD-RW drives). These devices are used to store computer programs and data. The display interface is typically connected to a computer monitor that visually displays information to a computer user. The network interface is used to communicate bi-directionally with other nodes connected to a computer network. The network interface may be a network interface card, a computer modem, or the like. Other computer processing systems, such as distributed computer processing systems, cloud-based computer processing systems and the like can also be used.

Many alterations and modifications of the disclosed process will be apparent to a person of ordinary skill in the art after having read the foregoing description, it is to be understood that the particular embodiments shown and described by way of illustration are in no way intended to be considered limiting. Further, the process has been described with reference to particular preferred embodiments, but numerous variations will occur to those skilled in the art. The inventive process is not intended to be limited to the particulars disclosed herein; rather, the present invention extends to all equivalent structures, methods and uses. It will therefore be appreciated by those skilled in the art that yet other modifications could be made to the provided invention without deviating from its spirit and scope as claimed.

What is claimed is:

1. A method for managing hydrocarbon exploration of a prospect, the method comprising:

for each process iteration of a plurality of process iterations, performing a number of operations including:

a) using a number of input parameters representing attributes of the prospect as input data to a risk-based probabilistic computer system, the risk-based probabilistic computer system generating estimates of probability-of-success and corresponding hydrocarbon volumes for the prospect as well as key performance indicators for the prospect in accordance with the input data;

b) reviewing the key performance indicators generated in a) to identify at least one gap in knowledge of the prospect as well as identify recommended exploration activities that address each identified knowledge gap;

c) performing one or more of the recommended exploration activities identified in b);

d) reviewing results arising from performance of the recommended exploration activities in c) to identify additional knowledge gained from such performance; and e) updating the input parameters to reflect the additional knowledge identified in d) for a next process iteration of the plurality of process iterations;

generating initial data defining an initial as-is characterization of the prospect; and using the initial data as at least a portion of the input data to said risk-based probabilistic computer system in a).

2. A method according to claim 1, wherein: the attributes relate to characteristics of the prospect selected from the group including i) Source-rock characteristics;

ii) Kerogen conversion to hydrocarbons;

iii) Hydrocarbon characteristics;

iv) Migration efficiency;

v) Reservoir characteristics;

vi) Trap timing; and vii) Recovery parameters.

3. A method according to claim 1, wherein:

the risk-based probabilistic computer system outputs a display of the estimates of probability-of-success and corresponding hydrocarbon volumes for the prospect.

4. A method according to claim 3, wherein:

the display comprises a cumulative frequency plot.

5. A method according to claim 1, wherein:

the key performance indicators for the prospect are metrics that aid in defining and evaluating success in the exploration of the prospect.

6. A method according to claim 5, wherein:

the key performance indicators are selected from the group including Chance of Technical Success (CTS), Chance of Economic Success (CES), Probabilistic Economic Resources (PER), Minimum Volume (MinV), and Maximum Volume (MaxV).

7. A method according to claim 1, wherein:

changes to key performance indicators from process iteration to process iteration reflect the value of the knowledge gained from the exploration activities performed in previous process iterations of the plurality of process iterations and serve as real measures of the value of having executed one or more of the recommended exploration activities.

8. A method according to claim 1, wherein:

the initial data is generated by execution of a software application that guides conversation amongst a number of representatives, the conversation pertinent to the initial as-is characterization of the prospect.

9. A method according to claim 8, wherein:

the software application stores the data electronically for use in a).

10. A method according to claim 1, wherein:

the recommended exploration activities identified in b) are selected from the group including i) re-processing of seismic data;

ii) migration modeling;

iii) basin structural modeling; and iv) acquisition and analysis of seismic data.

11. A method according to claim 1, wherein:

at least the operations of d) and e) involve conversations between representatives of a decision making entity.

12. A method according to claim 11, wherein:

the representatives of the entity include employees of the entity and consultants of a service company, the employees of the entity providing an understanding of the risk tolerance of the entity as well as the key performance indicators that are required for the prospect to satisfy such risk tolerance, and the consultants of the service company providing an understanding of the technologies that are likely to have a positive impact on the key performance indicators for the prospect.

13. A method for managing hydrocarbon exploration of a prospect, the method comprising:

for each process iteration of a plurality of process iterations, performing a number of operations including:

a) using a number of input parameters representing attributes of the prospect as input data to a risk-based probabilistic computer system, the risk-based probabilistic computer system generating estimates of probability-of-success and corresponding hydrocarbon volumes for the prospect as well as key performance indicators for the prospect in accordance with the input data;

b) reviewing the key performance indicators generated in a) to identify at least one gap in knowledge of the prospect as well as identify recommended exploration activities that address each identified knowledge gap;

c) performing one or more of the recommended exploration activities identified in b);

d) reviewing results arising from performance of the recommended exploration activities in c) to identify additional knowledge gained from such performance; and e) updating the input parameters to reflect the additional knowledge identified in d) for a next process iteration of the plurality of process iterations; and evaluating changes in the key performance indicators as a result of at least one process iteration to identify a classification for the prospect.

14. A method according to claim 13, wherein:

the classification for the prospect takes into account a risk profile for a decision making entity.

15. A method according to claim 13, wherein:

the classification represents that an evaluation stage is complete.

16. A method according to claim 13, wherein:

the classification represents that results of exploration activities for the prospect provide an inference of the presence of a commercially-viable hydrocarbon reservoir in a particular geographical area with acceptable risk and uncertainty.

17. A method according to claim 13, wherein:

the classification represents that results of exploration activities for the prospect provide an inference of the absence of a commercially-viable hydrocarbon reservoir in a particular geographical area with acceptable risk and uncertainty.

18. A method according to claim 13, wherein:

the classification represents that results of exploration activities for the prospect fail to provide an inference of the presence or absence of a commercially-viable hydrocarbon reservoir in a particular geographical area with acceptable risk and uncertainty.

19. A method according to claim 13, wherein:

the classification represents that further exploration activities are recommended.

20. A method according to claim 13, wherein:

the classification represents that postponement of further exploration activities is recommended.

21. A method according to claim 13, further comprising:

performing additional actions for the prospect based upon the classification.

* * * * *